US011642911B2

(12) United States Patent
Barberan Latorre

(10) Patent No.: US 11,642,911 B2
(45) Date of Patent: May 9, 2023

(54) METHOD FOR PRODUCING RELIEFS BY MEANS OF DIGITAL PRINTING AND DIGITAL PRINTING MACHINE

(71) Applicant: Jesus Francisco Barberan Latorre, Castelldefels (ES)

(72) Inventor: Jesus Francisco Barberan Latorre, Castelldefels (ES)

( * ) Notice: Subject to any disclaimer, the term of this patent is extended or adjusted under 35 U.S.C. 154(b) by 84 days.

(21) Appl. No.: 17/053,463

(22) PCT Filed: Apr. 25, 2019

(86) PCT No.: PCT/ES2019/070281
§ 371 (c)(1),
(2) Date: Nov. 6, 2020

(87) PCT Pub. No.: WO2019/215358
PCT Pub. Date: Nov. 14, 2019

(65) Prior Publication Data

US 2021/0245544 A1 Aug. 12, 2021

(30) Foreign Application Priority Data

May 7, 2018 (ES) ..... ES201830446

(51) Int. Cl.
*B44C 1/24* (2006.01)
*B41J 3/38* (2006.01)
*B41M 1/38* (2006.01)

(52) U.S. Cl.
CPC ..... *B44C 1/24* (2013.01); *B41J 3/38* (2013.01); *B41M 1/38* (2013.01)

(58) Field of Classification Search
CPC ..... B41J 3/38; B41M 1/38; B44C 1/24
See application file for complete search history.

(56) References Cited

U.S. PATENT DOCUMENTS 6,354,700 B1 * 3/2002 Roth ..... B41M 5/0256 347/102
2010/0192793 A1 8/2010 Verhaeghe
2014/0196618 A1 7/2014 Pervan et al.

FOREIGN PATENT DOCUMENTS

DE 102010010784 * 6/2011 ..... B44C 5/04
ES 2492693 T3 9/2014
WO 2012152327 A1 11/2012
WO 2016172589 A1 10/2016

OTHER PUBLICATIONS

International Search Report for Corresponding International Application No. PCT/ES2019/070281 (4 Pages) (Jun. 2, 2019).

* cited by examiner

*Primary Examiner* — Christopher E Mahoney
*Assistant Examiner* — Marissa Ferguson-Samreth
(74) *Attorney, Agent, or Firm* — Lucas & Mercanti, LLP

(57) ABSTRACT

A method for producing reliefs through digital printing and a digital printing machine is disclosed by method providing a substrate having a first digital print on one of the faces; applying a coating on the face of the substrate with the first digital print; partially drying the coating until a gelled state is obtained; depositing drops of ink to produce a second digital print; applying pressure to the gelled coating using an embossing roller to obtain a three-dimensional structure, the embossing roller configured to receive the second digital print and produce the three-dimensional structure; and completely drying the coating on which the three-dimensional structure has been obtained.

13 Claims, 6 Drawing Sheets

METHOD FOR PRODUCING RELIEFS BY MEANS OF DIGITAL PRINTING AND DIGITAL PRINTING MACHINE

CROSS REFERENCE TO RELATED APPLICATION

This Application is a 371 of PCT/ES2019/070281, filed on Apr. 25, 2019 which claims the benefit of Spanish Patent Application No. P201830446, filed on May 7, 2018, each of which are incorporated herein by reference.

TECHNICAL FIELD

The present invention is related to digital printing, proposing a method for producing a three-dimensional structure on a substrate, especially on a substrate in the form of a sheet or panel that is used as a decorative element for floors or furniture components. The invention also relates to a high-resolution digital printing machine for producing the three-dimensional structure on the substrate.

STATE OF THE ART

Producing relief imitations using traditional printing techniques is known, looking to ensure that the prints resemble the natural element that is imitated as much as possible, which in the case of wood are the colours and texture of the same with the corresponding characteristic grain.

In recent years, digital printing and inkjet laser technologies have replaced traditional printing techniques, making it possible to produce much cheaper high-quality prints. However, these printing techniques do not allow for a textured appearance that is still sometimes considered desirable.

To solve this problem, the digital embossing technique, which allows relief printing using digital printing techniques, is known. For this, transparent photo-polymeric inks are used which are printed on a pigmented ink, creating an illusion of relief printing, see for example document ES2492693T3. While this technique enables high-quality digital prints to be created with an illusion of relief that is noticeable to the eye, it does not enable reliefs to be created that are equally noticeable to the touch.

There is therefore a need for an alternative solution to be able to obtain high-quality digitally printed surfaces with a three-dimensional relief structure that is noticeable to the touch and to the eye.

OBJECT OF THE INVENTION

The objective of the present invention is to obtain decorative elements for floors, furniture components, or the like with digitally printed relief textures that are noticeable to the touch and to the eye, so that the decorative element resembles the natural element to be imitated as much as possible.

Accordingly, an object of the invention is a method for producing reliefs by means of high-resolution digital printing that comprises the steps of:

- providing a substrate having a first digital print on one of the faces thereof,
- applying a coating on the face of the substrate with the first digital print,
- partially drying the coating with the first digital print until a gelled state is obtained,
- depositing drops of ink in order to produce a second digital print,

- applying pressure to the gelled coating using an embossing roller in order to
- obtain a three-dimensional structure,
  - said embossing roller having an external surface configured to receive the second digital print with the deposited drops of ink, such that, by applying pressure, the drops of ink create cavities in the gelled coating in order to produce the three-dimensional structure; and
- completely drying the coating on which the three-dimensional structure has been obtained.

The second digital print with the deposited drops of ink is produced according to the following steps:

- receiving a data file with the first digital print of the substrate,
- identifying shapes and reliefs in the first digital print,
- depositing the drops of ink according to the shapes and reliefs identified in the first digital print, such that a positive relief is obtained which is pressed by the embossing roller against the gelled coating, defining a negative relief in the coating with which the three-dimensional structure is obtained.

In this way, the second digital print is used to engrave with pressure (emboss) the coating that is applied on the first digital print of the substrate, whereby relief textures that are noticeable to the touch and to the eye are obtained on the substrate.

According to an exemplary embodiment of the invention, the second digital print with the deposited drops of ink is applied directly on the external surface of the embossing roller. Thus, the roller can be re-embossed, so that different types of images and textures can be obtained without requiring the use of a textured embossing roller for each image to be obtained.

According to another exemplary embodiment of the invention, the second digital print of the deposited drops of ink is applied to an additional substrate which is pressed by the embossing roller against the coating. Said additional substrate can also be re-embossed and can be provided in the form of a continuous strip or in the form of a sheet between a supply roller and a sheet take-up roller.

The deposited drops of ink are removed after obtaining the three-dimensional structure on the coating, whereby the roller or continuous strip can be used to receive another digital print that can be applied to create a new three-dimensional structure. Preferably, the deposited drops of ink are removed by scraping and applying heat.

The drops of ink are deposited by using ink ejectors, so that by combining the deposit of the various ejectors, the thickness and shape of the relief textures applied on the substrate can be controlled.

Preferably, the coating is partially and completely dried by using ultraviolet UV light or LED-UV light, although depending on the features of the coating, air drying could even be used.

Preferably, the coating is a delayed drying varnish or glue that is especially suitable for receiving a negative relief on it which creates the three-dimensional structure.

Another object of the invention is the high-resolution digital printing machine used for producing the reliefs, which comprises:

- means for providing a substrate having a first digital print on one of the faces thereof,
- a unit for applying a coating on the face of the substrate with the first digital print,
- a first drying unit for partially drying the coating until a gelled state is obtained, an embossing roller for applying pressure to the coating and obtaining a three-dimensional structure, said embossing roller having an external surface configured to receive a second digital print with deposited drops of ink, such that, by applying pressure, the drops of ink create cavities in the gelled coating in order to produce the three-dimensional structure, a second drying unit for completely drying the coating on which the three-dimensional structure has been obtained.

The second digital print with the deposited drops of ink can be applied directly on the embossing roller or the machine may additionally comprise means for providing an additional substrate on which the second digital print with the deposited drops of ink can be applied. Said means comprise a set of rollers that direct the additional substrate with the second digital print towards the embossing roller in order to apply pressure to the coating and obtain the three-dimensional structure.

The machine additionally comprises means for removing the drops of ink from the second digital print. In the event that the second digital print is applied directly to the embossing roller, said means comprise scrapers for removing the drops of ink from the external surface of the embossing roller, so that the roller can be reused to texturise a new substrate. In the event that the second digital print is applied on the additional substrate, said means comprise a unit with solvent through which the additional substrate is passed, or means for applying heat, or another similar system that enables the second digital print to be removed.

The machine additionally comprises ink ejectors for depositing drops of ink on the external surface of the embossing roller or on the additional substrate, so that by superimposing drops of ink, different shapes with which to texture the coating applied on the substrate can be obtained.

The drying units are ultraviolet UV light lamps or LED-UV light lamps, which are especially configured to partially gel the coating in one case, leaving it ready to be textured, and to completely gel the coating in another case, permanently maintaining the texturing.

DETAILED DESCRIPTION OF THE INVENTION

The object of the invention relates to a method and a machine for high-resolution digital printing of substrates (1), whereby relief textures can be obtained that are noticeable to the touch and to the eye, so that the printed substrate (1) resembles the natural element to be imitated as much as possible.

Figure 1:
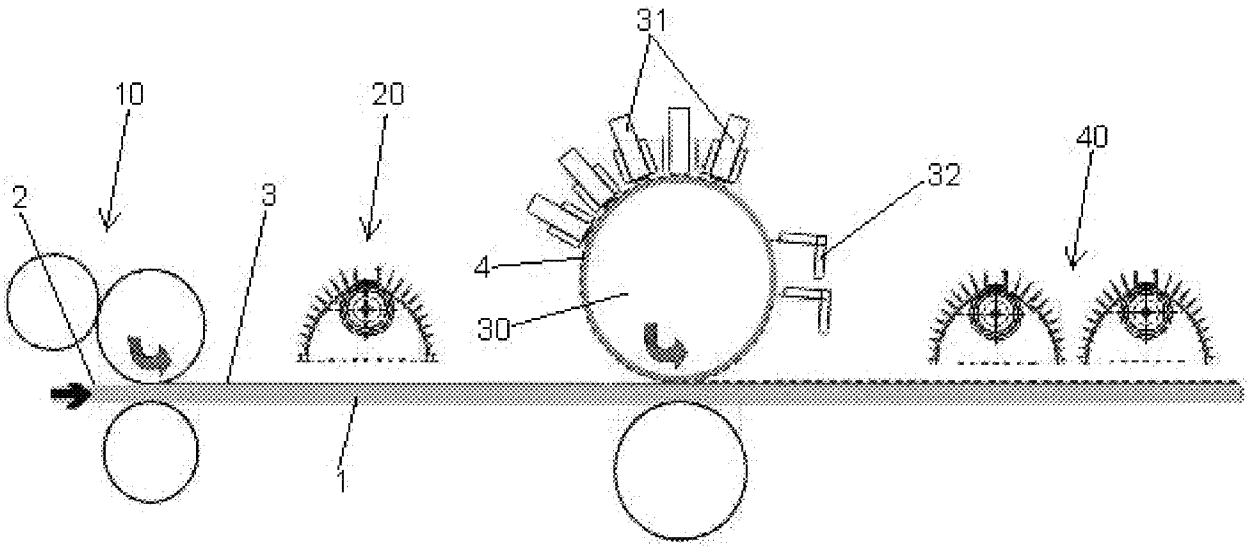
FIG. 1 shows an exemplary embodiment of the digital printing machine of the invention for producing reliefs on panels, wherein the digital print with drops of ink is applied directly on the embossing roller.

FIG. 1 shows an exemplary embodiment of the digital printing machine for obtaining substrates with reliefs. The different parts of the machine are described according to the feed of the substrate (1), that is, in the direction from left to right as shown in the figures.

The machine comprises means for providing the substrate (1), the substrate (1) having a first digital print (2) on one of the faces thereof, a unit (10) for applying a coating (3) on the face of the substrate (1) having the first digital print (2), a first drying unit (20) for partially drying the coating (3), an embossing roller (30) for applying pressure to the coating (3) and obtaining a three-dimensional structure and a second drying unit (40) for completely drying the coating (3) having the three-dimensional structure.

The embossing roller (30) has an external surface on which a second digital print (4) can be applied by depositing drops of ink, so that said second digital print (4) is used to obtain the three-dimensional structure on the coating (3) in correspondence with the first digital print (2) of the substrate (1).

The second digital print (4) that is applied on the embossing roller (30) allows the first digital print (2) that is applied on the substrate (1) to be textured, so that the embossing roller (30) acts as a roller that can be re-embossed, being able to receive as many digital prints (4) as substrates (1) to be textured on its surface.

To apply the second digital print (4) by depositing drops of ink, ink ejectors (31) are used. The ink ejectors (31) that apply the second digital print (4) on the embossing roller (30) can be part of the digital printing machine, or they can be a unit external to the machine, so that the second digital print (4) is already applied on the embossing roller (30) of the machine during the process of applying the relief.

Figure 2:
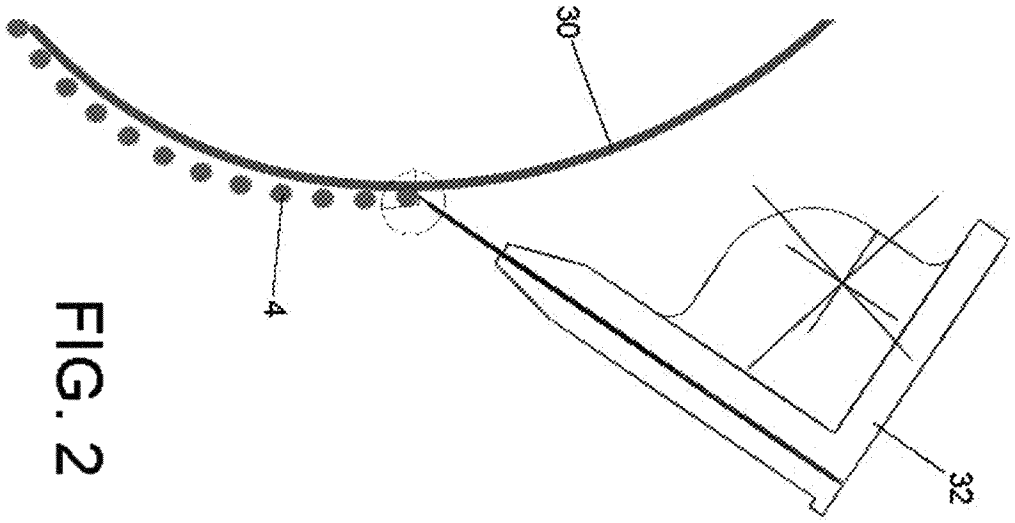
FIG. 2 shows a detailed enlargement of the scraper that is used to remove the digital print with drops of ink that is applied on the embossing roller.

The machine has means (32) for removing the drops of ink from the second digital print (4), such as, for example, scrapers (see FIG. 2). In this way, in the event that another type of texture must be applied on the substrate (1), it would be enough to remove the drops of ink from the embossing roller (30) and reapply a new second digital print (4). Said means (32) can incorporate a heat source that facilitates the removal of the drops of ink.

The scrapers are made from high-quality steel strapping especially designed for cleaning scrapers that have a high-hardness edge to ensure that the scrapers properly clean the embossing roller (30).

The drying units (20;40) are selected depending on the type of coating (3) that is applied on the substrate (1). Preferably, the drying units (20,40) are UV light lamps or LED-UV light lamps.

Preferably, the coating (3) that is applied on the substrate is a delayed drying varnish or glue.

Figure 4:
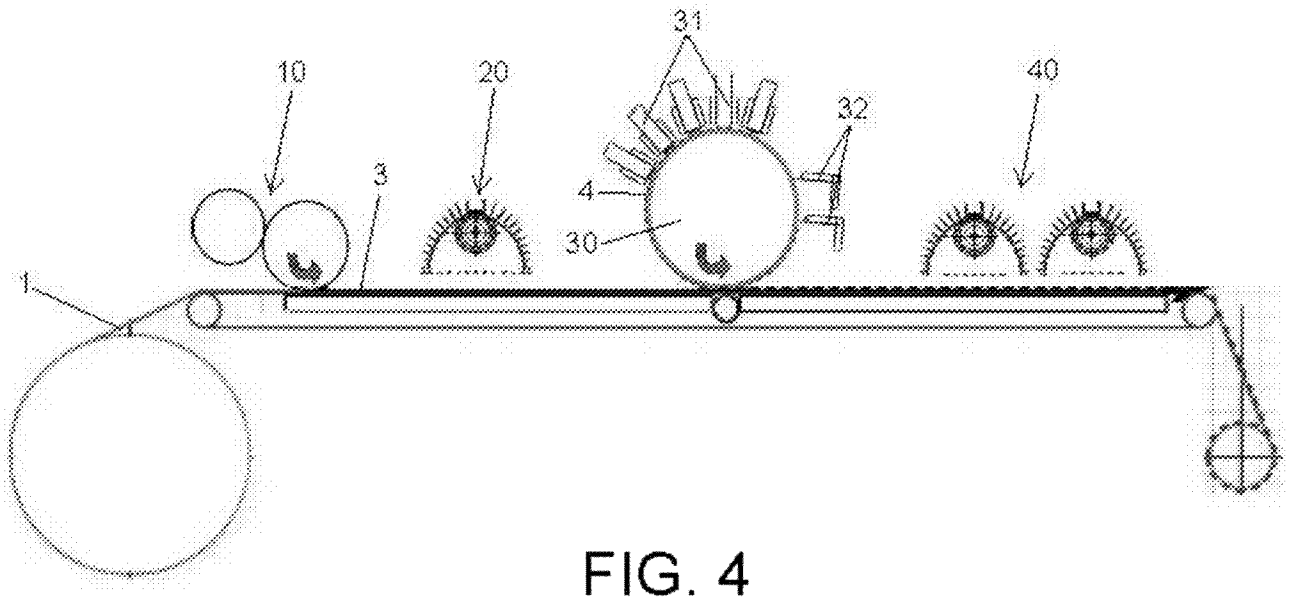
FIG. 4 shows another exemplary embodiment of the digital printing machine of the invention for producing reliefs on sheets, wherein the digital print with drops of ink is also applied directly on the embossing roller.

In FIG. 1, a digital printing machine is shown wherein a substrate (1) is provided in the form of a panel, while in FIG. 4 a digital printing machine is shown wherein the means for providing the substrate are adapted to feed a substrate (1) in sheet format, so that said providing means have a station for unwinding the substrate (1) with the digital print (2) and a station for winding the substrate (1) with the coating (3).

Figure 5:
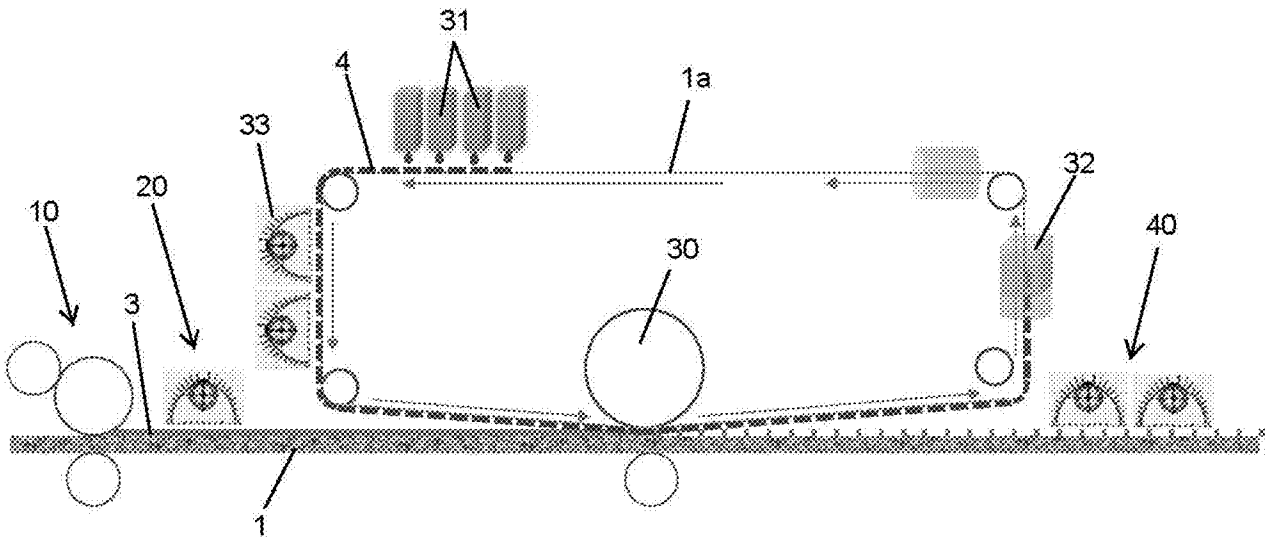
FIGS. 5 and 6 show other exemplary embodiments of the digital printing machine of the invention wherein the digital print with drops of ink is not applied directly on the embossing roller but on an additional substrate.
Figure 6:
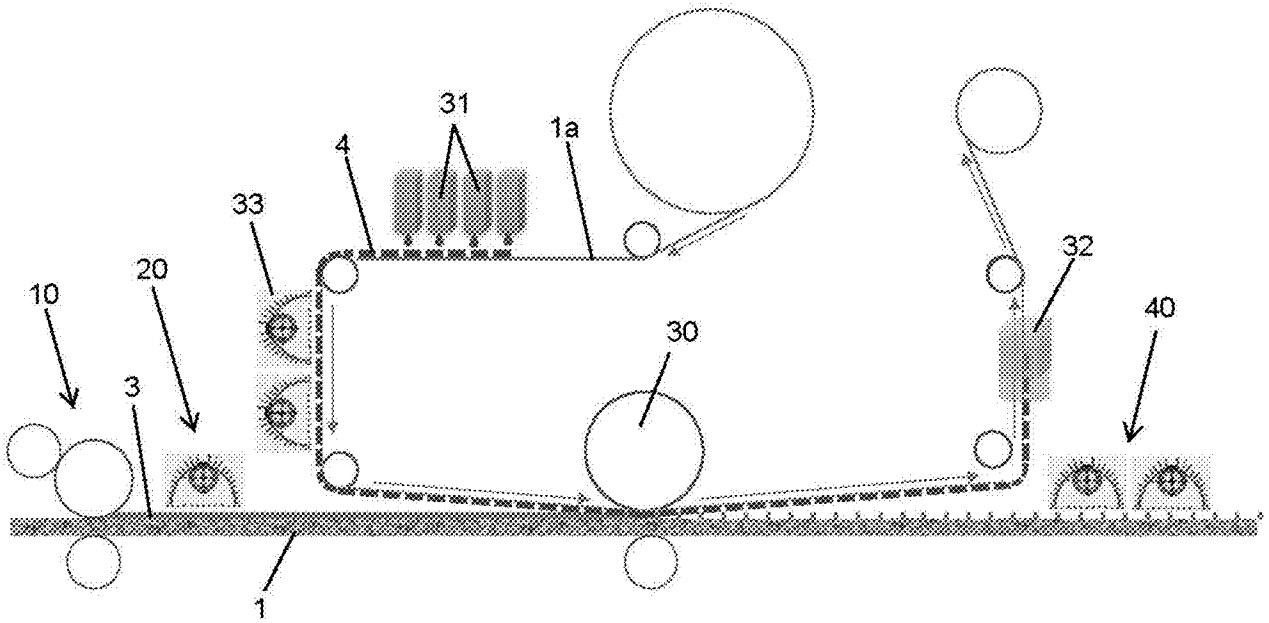

FIGS. 5 and 6 show other digital printing machines according to the invention. Said machines are identical to the machines of FIGS. 1 and 4, wherein only the manner of applying the drops of ink of the second digital print (4) differs, since in the machines of FIGS. 1 and 4 the second digital print (4) is applied directly on the external surface of the embossing roller (30), while in the machines of FIGS. 5 and 6 the second digital print (4) is applied on an additional substrate (1*a*).

Thus, the machines of FIGS. 5 and 6 comprise the means for providing the substrate (1) with the first digital print (2), the unit (10) for applying the coating (3) on the face of the substrate (1) having the first digital print (2), the first drying unit (20) for partially drying the coating (3), the embossing roller (30) for applying pressure to the coating (3) and obtaining a three-dimensional structure and the second unit drying (40) for completely drying the coating (3) having the three-dimensional structure.

The machines of FIGS. 5 and 6 have means for providing the additional substrate (1*a*), said means comprising a set of rollers that first direct the additional substrate (1*a*) towards the ink ejectors (31) which apply the second digital print (4) on the additional substrate (1*a*), then they direct the additional substrate (1*a*) towards a partial drying unit (33) of the second digital print (4), then they direct the additional substrate (1*a*) towards the embossing roller (30) in order for pressure to be applied to the coating (3), and they finally direct the additional substrate (1*a*) towards the means (32) to remove the drops of ink from the second digital print (4).

Said means (32) are used to remove the drops of ink from the second digital print (4) and to be able to re-use the additional substrate (1*a*) to receive a new second digital print (4). The means (32) can be a unit with solvent through which the additional substrate (1*a*) is passed, or means for applying heat, or any other similar system that enables the second digital print (4) to be removed.

The set of rollers for providing the additional substrate (1*a*) of the machine of FIG. 5 forms a closed path, so that the additional substrate (1*a*) is provided in the form of a continuous strip. Alternatively, the set of rollers of the machine of FIG. 6 forms an open path, so that the additional substrate (1*a*) is provided in the form of a sheet between a supply roller and a sheet take-up roller.

Accordingly, to produce the reliefs, the substrate (1) is first provided in the form of a sheet or panel, wherein the first digital print (2) of the substrate (1) is arranged on the upper face thereof. The substrate is passed through the unit (10) wherein the coating (3) is applied on the face of the substrate (1) having the first digital print (2); immediately afterwards the first drying unit (20) applies heat on the coating (3) to partially dry it until a gelled state suitable for deformation is obtained.

After applying the coating (3), the substrate (1) is passed through the embossing roller (30) which is configured to receive the second digital print (4) on its surface, directly or indirectly through the additional substrate (1*a*), so that the roller (30) applies pressure to the coating (3), deforming it and obtaining the three-dimensional structure that textures the first digital print (2) of the substrate (1) in the coating (3).

The second digital print (4) which is pressed by the embossing roller (30) is in a gelling (drying) state, such that when it comes into contact with the coating (3) it deforms it without adhering to it.

Finally, the substrate (1) with the embossed coating (3) is passed through the second drying unit (40) to completely dry the coating (3) and obtain the substrate (1) with the desired texture and shape.

If the coating (3) used allows it, partial and/or complete drying can be carried out without applying heat, leaving only the coating to air dry.

The second digital print (4) with which the three-dimensional structure of the coating (3) is obtained has correspondence with the first digital print (2) of the substrate (1), so that the second digital print (4) corresponds to a series of shapes that are expressly printed on the embossing roller (30), or on the additional substrate (1*a*), to texturise and create a relief of the desired areas of the first digital print (2) with which the substrate is printed (1).

To obtain the deposited drops of ink of the second digital print (4), a control unit is used that firstly is responsible for receiving a data file that contains information on the first digital print (2) with which the substrate (1) is printed, and which is to be textured. The control unit is responsible for identifying shapes and reliefs in the first digital print (2), which, in the event of wanting to give the substrate (1) a wood appearance, can correspond to knots or grains, and according to this identification it commands the ink ejectors (31) to deposit the drops of ink on the surface of the embossing roller (30) or on the additional substrate (1*a*).

Figure 3:
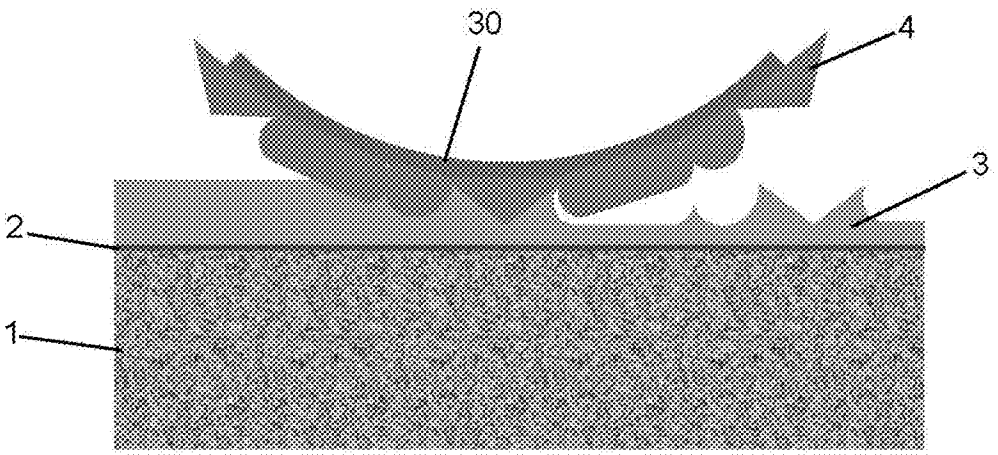
FIG. 3 shows a detailed view of the embossing roller obtaining the three-dimensional structure on the coating of the substrate.

Thus, as shown in detail in FIG. 3, the drops of ink of the second digital print (4) deposited on the embossing roller (30) or, where appropriate, on the additional substrate (1*a*) define a positive relief, and after applying pressure to the coating (3) in the gelled state, said positive relief defines a negative relief in the coating (3) that gives rise to the three-dimensional structure.

The invention claimed is:

1. A method for producing reliefs by means of digital printing, comprising the stages of:

providing a substrate having a first digital print on one of the faces thereof, applying a coating on the face of the substrate with the first digital print, partially drying the coating with the first digital print until a gelled coating is obtained, depositing drops of ink to produce a second digital print, applying pressure to the gelled coating using an embossing roller to obtain a three-dimensional structure, said embossing roller having an external surface configured to receive the second digital print with the deposited drops of ink, such that, by applying pressure, the drops of ink create cavities in the gelled coating to produce the three-dimensional structure; and completely drying the gelled coating on which the three-dimensional structure has been obtained, wherein the second digital print with the deposited drops of ink is produced according to the following steps:

receiving a data file with the first digital print of the substrate, identifying shapes and reliefs in the first digital print, depositing the drops of ink according to the shapes and reliefs identified in the first digital print, such that a positive relief is obtained which is pressed by the embossing roller against the gelled coating, defining a negative relief in the coating with which the three-dimensional structure is obtained.

2. The method for producing reliefs by means of digital printing, according to claim 1, wherein the second digital print with the deposited drops of ink is applied directly on the external surface of the embossing roller.

3. The method for producing reliefs by means of digital printing, according to claim 1, wherein the second digital print with the deposited drops of ink is applied on an additional substrate which is pressed by the embossing roller against the coating.

4. The method for producing reliefs by means of digital printing, according to claim 1, wherein the deposited drops of ink are removed after obtaining the three-dimensional structure on the coating.

5. The method for producing reliefs by means of digital printing, according to claim 4, wherein the deposited drops of ink are removed by scraping and applying heat.

6. The method for producing reliefs by means of digital printing, according to claim 1, wherein the drops of ink are deposited by using ink ejectors.

7. The method for producing reliefs by means of digital printing, according to claim 1, wherein the coating is partially and completely dried using UV light or LED-UV light.

8. The method for producing reliefs by means of digital printing, according to claim 1, wherein the coating is a delayed drying varnish or glue.

9. A digital printing machine for producing reliefs, comprising:

means for providing a substrate having a first digital print on one of the faces thereof, a unit for applying a coating on the face of the substrate with the first digital print, a first drying unit for partially drying the coating until a gelled state is obtained, an embossing roller for applying pressure to the coating and obtaining a three-dimensional structure, said embossing roller having an external surface configured to receive a second digital print with deposited drops of ink, such that, by applying pressure, the drops of ink create cavities in the gelled coating in order to produce the three-dimensional structure, a second drying unit for completely drying the coating on which the three-dimensional structure has been obtained, wherein the second digital print with the deposited drops of ink is configured to:

receive a data file with the first digital print of the substrate, identify shapes and reliefs in the first digital print, deposit the drops of ink according to the shapes and reliefs identified in the first digital print, such that a positive relief is obtained which is pressed by the embossing roller against the gelled coating, defining a negative relief in the coating with which the three-dimensional structure is obtained.

10. The digital printing machine for producing reliefs, according to claim 9, further comprising means for providing an additional substrate on which the second digital print with the deposited drops of ink can be applied.

11. The digital printing machine for producing reliefs, according to claim 9, further comprising means for removing drops of ink.

12. The digital printing machine for producing reliefs, according to claim 9, further comprising ink ejectors for depositing drops of ink on the external surface of the embossing roller or on the additional substrate.

13. The digital printing machine for producing reliefs, according to claim 9, wherein the first and second drying units are UV light lamps or LED-UV light lamps.

* * * * *